US010759450B2

(12) United States Patent
Bourbon

(10) Patent No.: US 10,759,450 B2
(45) Date of Patent: Sep. 1, 2020

(54) SYSTEM FOR SECURING A SCREEN DOOR MODULE TO A PLATFORM AND ASSOCIATED ERECTION METHOD

(71) Applicant: Faiveley Transport Tours, Saint Pierre des Corps (FR)

(72) Inventor: Bruno Bourbon, Esvres sur Indre (FR)

(73) Assignee: Faiveley Transport Tours, Saint Pierre des Corps (FR)

( * ) Notice: Subject to any disclaimer, the term of this patent is extended or adjusted under 35 U.S.C. 154(b) by 349 days.

(21) Appl. No.: 15/737,841

(22) PCT Filed: May 31, 2016

(86) PCT No.: PCT/EP2016/062233
§ 371 (c)(1),
(2) Date: Dec. 19, 2017

(87) PCT Pub. No.: WO2016/202573
PCT Pub. Date: Dec. 22, 2016

(65) Prior Publication Data

US 2019/0001995 A1 Jan. 3, 2019

(30) Foreign Application Priority Data

Jun. 19, 2015 (EP) ..... 15305953

(51) Int. Cl.
*B61B 1/02* (2006.01)
*E06B 3/46* (2006.01)

(52) U.S. Cl.
CPC ..... *B61B 1/02* (2013.01); *E05Y 2900/404* (2013.01); *E06B 3/4636* (2013.01)

(58) Field of Classification Search
CPC .... B61B 1/02; E05Y 2900/404; E06B 3/4636
See application file for complete search history.

(56) References Cited

U.S. PATENT DOCUMENTS 4,551,944 A * 11/1985 Donaldson ..... B61B 1/02 49/262
5,253,589 A * 10/1993 Kawanishi ..... B61B 1/02 104/28

(Continued)

FOREIGN PATENT DOCUMENTS

FR 3 002 780 9/2014
WO WO 2013/001669 1/2013

OTHER PUBLICATIONS

Devilliere L., "Le défi de l'installatuion des facades de quai", Revue Generale Des Chemins de Fer, Centrale Des Revues Dunod-Gauthier-Villars, Paris, FR, No. 223, Jan. 1, 2013, pp. 78-89, NPL Reference No. XP001537473; FR—ISSN 0035-3183, the whole document.

(Continued)

*Primary Examiner* — Zachary L Kuhfuss
(74) *Attorney, Agent, or Firm* — The Small Patent Law Group LLC; Mary D. Lawlor

(57) ABSTRACT

A system for securing a screen door module to a platform extending along a route and having at least one upright at each end and a threshold between the end uprights. The system includes a first platform edge coping plate, a second platform edge coping plate, a first base mounted fixedly on one of the first and second platform edge coping plates, a second base mounted with the ability to move in a translational movement in a direction parallel or tangential to the route, and in a direction closer toward or further away from the first base on the other of the first and second platform edge coping plates, and means of securing and adjusting the end uprights on the first and second bases.

19 Claims, 6 Drawing Sheets

(56) References Cited

U.S. PATENT DOCUMENTS

| | | | | |
|---|---|---|---|---|
| 5,794,746 | A * | 8/1998 | Ketonen | B66B 13/301 187/333 |
| 6,938,380 | B2 * | 9/2005 | Friedman | B66B 13/301 49/505 |
| 7,721,653 | B1 * | 5/2010 | Burgess | B61B 1/02 104/27 |
| 7,788,854 | B2 * | 9/2010 | Friedman | B66B 13/301 49/468 |
| 8,079,178 | B2 * | 12/2011 | Lin | E06B 1/524 49/365 |
| 8,387,541 | B2 * | 3/2013 | Losito | B61B 1/02 104/28 |
| 9,266,538 | B2 * | 2/2016 | Reichling | B61B 1/02 |
| 9,903,151 | B2 * | 2/2018 | Bourbon | E06B 1/524 |
| 2003/0111297 | A1 | 6/2003 | Friedman | |
| 2006/0054419 | A1 | 3/2006 | Friedman | |
| 2008/0190031 | A1 * | 8/2008 | Winkelmann | E05F 15/643 49/427 |
| 2012/0120234 | A1 * | 5/2012 | Fullalove | B61B 1/02 348/143 |
| 2016/0222716 | A1 * | 8/2016 | Kim | E05D 13/00 |
| 2016/0318525 | A1 * | 11/2016 | Lardy | B61B 1/02 |
| 2017/0002600 | A1 * | 1/2017 | Bourbon | E06B 1/524 |
| 2018/0170401 | A1 * | 6/2018 | Tenet | E06B 3/4636 |
| 2019/0001995 | A1 * | 1/2019 | Bourbon | B61B 1/02 |
| 2019/0084586 | A1 * | 3/2019 | Leizer | H04W 4/023 |
| 2019/0383089 | A1 * | 12/2019 | Gaviglia | E04B 1/92 |

OTHER PUBLICATIONS

International Search Report (6 pages including English translation) dated Aug. 30, 2016 from PCT priority Application No. PCT/EP2016/062233.

* cited by examiner

SYSTEM FOR SECURING A SCREEN DOOR MODULE TO A PLATFORM AND ASSOCIATED ERECTION METHOD

This application claims priority to International Application No. PCT/EP2016/062233 filed May 31, 2016 and to European Application No. 15305953.0 filed Jun. 19, 2015; the entire contents of each are incorporated herein by reference.

BACKGROUND

The invention relates to a system for fixing a screen door module to a platform edge. The invention also relates to a method for mounting a screen door module on a platform using the fixing system according to the invention.

SUMMARY

Creating a dividing screen between a platform and a track, such as a train track or subway track, imposes time constraints, operating constraints and installation constraints. The time constraint is due to the fact that installing such a screen needs to be done between two services, namely over a period of approximately three operating hours, at night. The operating constraint is due to the fact that the screen installed during two services needs to be functional right from the start of the service, the morning following installation. The installation constraint is due to a number of factors which may occur together:

High loads including the ever increasing crowd pressure (3000 N/linear m) is added to the piston effect of the running train;

Reinforcement of the bottom fixing to the platform in the case of screen doors that have no top fixing.

The use of screen door modules makes it possible in part to alleviate some of the abovementioned constraints, these modules being assembled at a location more or less distant from the platform that is to be equipped and then transported thereto for installation. It is therefore necessary to have prepared the platform edge beforehand and to have a fixing system that allows screen door modules to be laid quickly, efficiently and optimally.

To this end, the invention provides a system for fixing a screen door module to a platform extending along a track and comprising at least one upright at each end and a sill between the end uprights, which system comprises:

a first platform-edge plate, a second platform-edge plate, a first base mounted fixedly on one among the first and second platform-edge plates, a second base mounted movably on the other among the first and second platform-edge plates with a translational movement in a direction parallel or tangential to the track, and in a direction of moving towards, or moving away from, the first base, means for fixing and adjusting the end uprights on the first and second bases.

Thus, the fact of having platform-edge plates means that a reference surface can be created that is optimal for installing the screen door module. The presence of bases on each of the platform-edge plates with one of the bases being translationally mobile, makes it possible easily to adjust them to the actual distance between the uprights of the screen door module, which actual distance is dependent on the build-up of assembly clearances of the screen door module. Finally, the fixing and adjusting means make it possible, among other things, to adjust the verticality of the uprights of the screen door module. Thus, the laying of the screen door module is quick, efficient and optimal.

Advantageously, but optionally, the fixing system according to the invention has at least one of the following additional technical features: the fixing system comprises a system for mounting the bases on the platform-edge plates, which system comprises a clamping screw and a spacer received in an oblong opening passing through a thickness of the base in question;

the spacer of the system for mounting the second base has a thickness which is greater than the thickness of the base through which the oblong opening passes the oblong opening;

the spacer of the system for mounting the first base has a thickness which is less than the thickness of the base through which the oblong opening passes the oblong opening;

the oblong opening has a counterbore for receiving a head of the screw;

the fixing and adjusting means comprise at least one adjusting and clamping unit comprising a jack screw bearing against the base in question, which jack screw is intended to be screwed into the sill in the vicinity of a foot of the end upright in question, and a clamping tie rod passing through the jack screw and the base in question;

with the platform-edge plate in question being traversed by the clamping tie rod, the platform-edge plate in question has a through-orifice receiving the tie and having a diameter which is greater than a diameter of the clamping tie rod;

the clamping tie rod is anchored in an edge of the platform;

the clamping tie rod passes through a thickness of a platform edge and the fixing and clamping means additionally comprise an under-platform fixing plate cooperating with the clamping tie rod;

the jack screw comprises a spherical end-piece and the base in question comprises a conical washer arranged so as to receive in abutment the spherical end-piece of the jack screw;

the fixing means comprise three adjusting and clamping units positioned in a triangle;

the first and second bases each comprise a stud for centering the end upright which is intended to be fixed to the base in question;

at least one among the first and second platform-edge plates forms the other of the first and second platform-edge plates of a system for fixing an adjacent screen door module;

the first and second bases are made of an electrically insulating material, and the first and second bases have a functional clearance therebetween that is arranged so as to make it possible to give a relative inclination between the first and second bases in a plane of the platform.

The invention also provides a method for mounting, with the aid of a fixing system having at least one of the above features, a screen door module on a platform extending along a track and comprising at least one upright at each end, which method comprises steps of:

(a) placing the first and second platform-edge plates at the platform edge at a distance from one another corresponding to a distance between the end uprights of the screen door module; then, (b) placing and fixing the first and second bases respectively on the first and second platform-edge plates; then, (c) bringing in the preassembled screen door module and laying the screen door module on the first and second bases, by possible sliding of the second base with respect to the first base; then, (d) implementing the fixing and adjusting means associated with the first and second bases so as to ensure the verticality and the fixing of the end uprights.

Advantageously, but optionally, the mounting method according to the invention has at least one of the following additional technical features:

step (a) comprises a substep of drilling through-orifices in a thickness of the platform edge opposite the tie-receiving through-orifices of the platform-edge plates;

step (b) comprises a substep of producing tappings in the platform-edge plates, which tappings are intended to receive by screwing the clamping screws of the systems for mounting the bases on the platform-edge plates; and, step (d), for each end upright of the screen door, comprises substeps of:

placing the clamping tie rods through the foot of the end upright in question, through the associated base, through the associated platform-edge plate and through the platform edge by screwing the ties to the associated under-platform fixing plate or into anchorings; then adjusting the verticality of the end upright in question by putting the jack screws to use; then, finally clamping the clamping tie rods.

BRIEF DESCRIPTION OF THE DRAWINGS

Further features and advantages of the invention will become apparent during the course of the following description of one embodiment. In the attached drawings.

DETAILED DESCRIPTION

Figure 1:
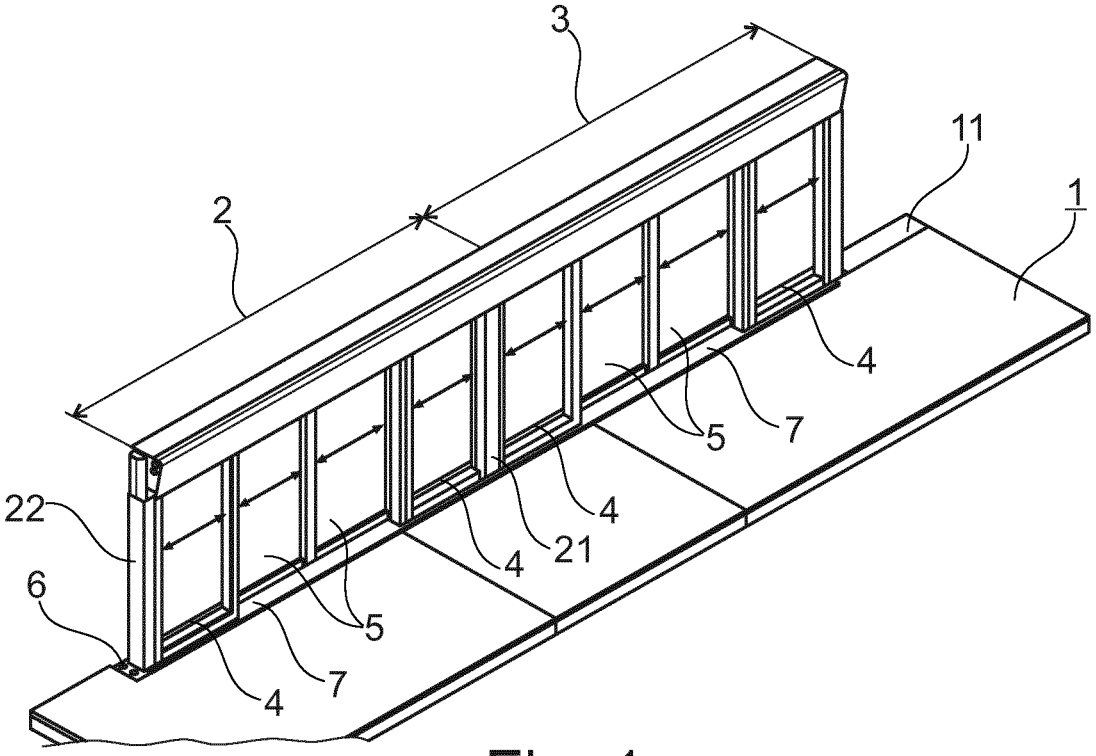
FIG. 1 is a three-dimensional view of a set of platform screen doors installed on a platform edge.
Figure 2:
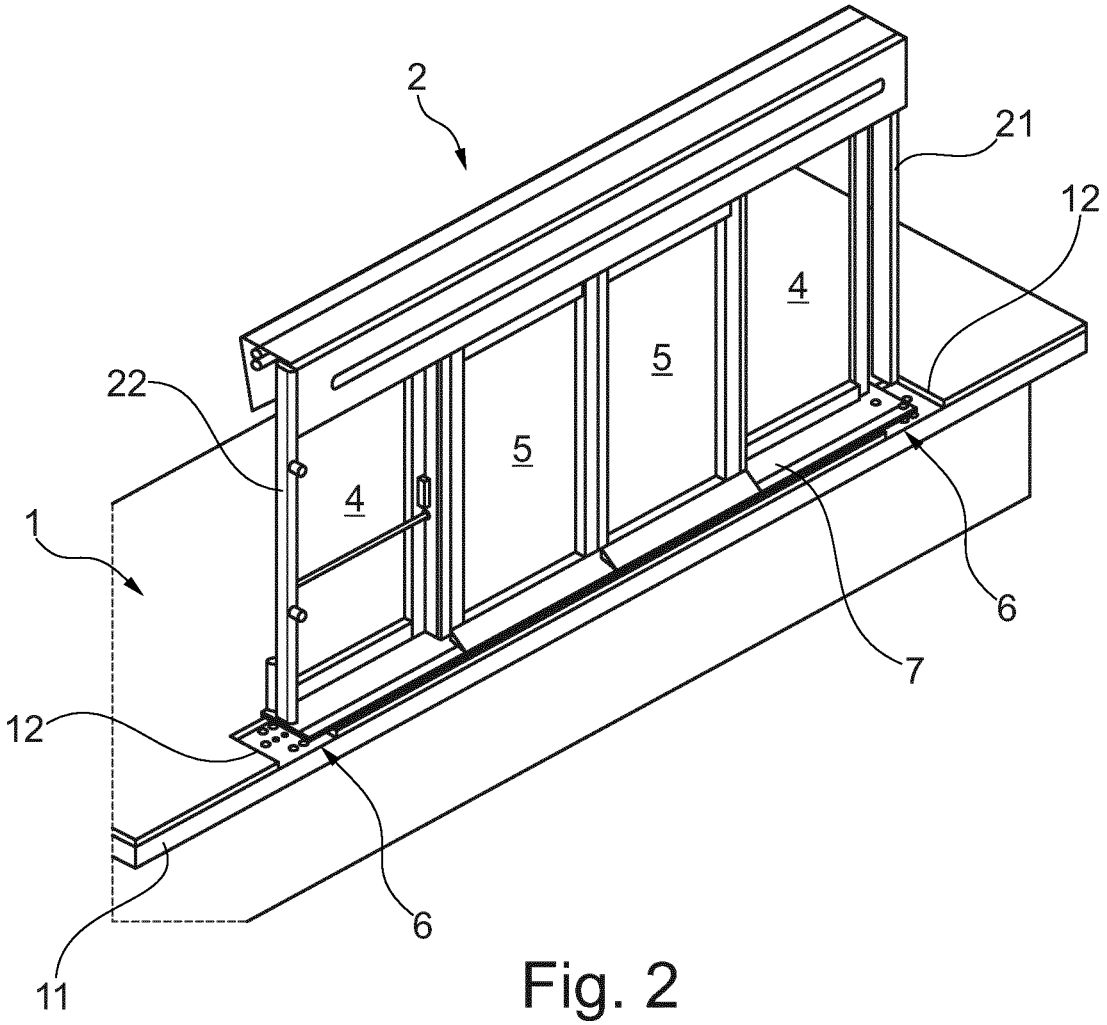
FIG. 2 is a three-dimensional view of a screen door module installed on a platform edge using a fixing system according to the invention.

A platform 1 equipped with screen doors will be described briefly with reference to FIG. 1 and FIG. 2. The platform 1 is arranged along a track (visible in FIG. 3). A set of screen doors is arranged at a platform edge 11. In this instance, the screen doors form screen door modules 2, 3. Each screen door module 2, 3 comprises an access passage which is closed off or opened up by a pair of sliding doors, each made up of a sliding leaf 5. On each side of the passage, the screen door modules 2, 3 each comprise two fixed parts each equipped with an emergency door comprising an emergency leaf 4. The two fixed parts surround the access passage associated with the screen door module. Each of the sliding leaves 5 moves translationally with respect to the fixed part to which it is connected. Each of the screen door modules 2, 3 comprise two end uprights 21, 22 surrounding the set formed by the two fixed parts and the two sliding doors. At platform level, the screen door modules 2, 3 comprise a door sill 7 which extends from the end upright 21 as far as the other end upright 22 whilst crossing the access passage. At the foot of the end uprights 21, 22 a fixing system 6 according to the invention is used to connect the screen door module 2, 3 to the platform edge 11. The fixing system 6 according to the invention is partially housed in an excavation 12 formed on an upper surface of the platform edge 11.

The fixing system 6 according to the invention will be described with reference to FIG. 7 and to FIG. 8. The fixing system 6 according to the invention comprises a first 61 and a second 61' platform-edge plate. Each of the first 61 and second 61' platform-edge plates is associated with an end upright 21, 22 respectively. The first 61 and second 61' platform-edge plates are fitted ahead of the installing of a screen door module 2, 3. The first 61 and second 61' platform-edge plates are positioned in excavations 12 produced by the civil engineers in the platform edge 11 at an upper surface of the platform 1. Special laying tooling is used in order to have precision in the laying of the platform-edge plates 61, 61'. This precision is obtained in relation to an axis V of the track along which the platform 1 is formed (see FIG. 3), with respect to a depth in the excavation 12 and in a direction parallel to the axis V of the track, or a direction tangential to the track in the event of the latter being curved. In a frame of reference R (X,Y,Z), each platform-edge plate 61, 61' is positioned in this frame of reference R according to coordinates (Xi, Yi, Zi) of a notable point of reference of the platform-edge plate 61, 61', each of the coordinates (Xi, Yi and Zi) including a level of precision of implementation respecting the civil engineering standard. Specifically, it is important to have optimal positioning of the platform-edge plates 61, 61' because these will define a reference surface for installing the screen door modules 2, 3 on the edge 11 of the platform 1. With reference to FIG. 4, the platform-edge plate 61, 61' is a double plate and intended here to straddle two adjacent screen door modules 2, 3. In fact, in this situation, the double platform-edge plate 61, 61' forms simultaneously:

the first platform-edge plate 61 of the fixing system 6 according to the invention for fixing a screen door module 3, associated with the end upright 22, and the second platform-edge plate 61' of the fixing system 6 according to the invention for fixing another screen door module 3 adjacent to the previous screen door module 2 and associated with the end upright 21.

The double platform-edge plate 61, 61' comprises two series of through-orifices 611 passing through a thickness of the double platform-edge plate 61, 61'. In this instance, each series comprises three through-orifices 611, the two series being positioned with mirror symmetry with respect to a mid-plane of the double platform-edge plate 61, 61', which mid-plane is perpendicular to the axis V of the track, and therefore perpendicular to the edge 11 of the platform 1. Each series of through-orifices 611 forms the vertices of a triangle.

The fixing system 6 further comprises a first base 62 and a second base 63. These bases 62, 63 will be described in relation to FIGS. 5, 6*a* and 6*b*. The first base 62 comprises a series of through-orifices 623 passing through a thickness of the first base 62 and positioned in such a way that when the first base 62 is mounted on the first platform-edge plate 61, the series of through-orifices 623 align with the series of through-orifices 611 of the first platform-edge plate 61. Furthermore, the first base 62 comprises at least one oblong through-opening 621 passing through a thickness of the first base 62. In this instance there are two oblong through-openings 621 which are parallel to one another and which are, once the first base 62 has been mounted on the first platform-edge plate 61, parallel to the axis V of the track. Each of the oblong through-openings 621 comprises, from the top downwards:

a counterbore 631 ending around mid-thickness of the first base 62 with a rim 632; then, a slot 633 passing through the remainder of the thickness of the first base 62 from the rim 632.

Figure 6A:
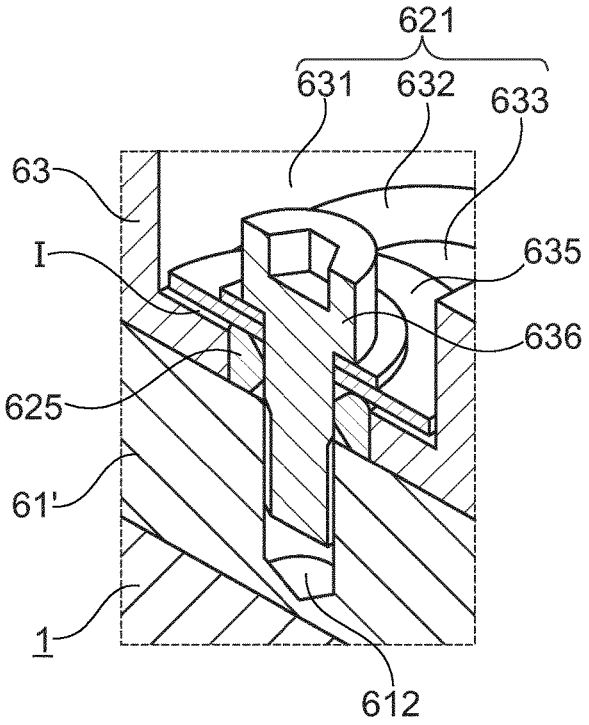
FIGS. 6*a* and 6*b* are three-dimensional views in cross section of detail VI of FIG. 5, according to two embodiments.
Figure 6B:
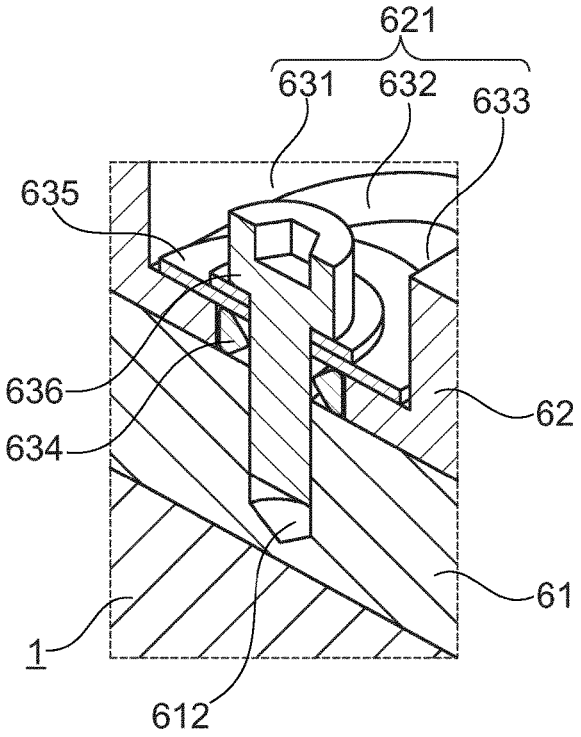

The fixing system 6 according to the invention comprises a mounting system 634,635,636 for mounting the first base 62 on the first platform-edge plate 61. The first platform-edge plate 61 for that purpose comprises tappings 612 produced at the time of fixing of the first base 62. The mounting system for mounting the first base 62 on the first platform-edge plate 61 comprises a screw 636 having a screw thread designed to collaborate with the associated tapping 612. The mounting system further comprises a thrust washer 635 and a spacer 634. The spacer 634 is housed with sliding in the slot 631 of the oblong through-opening 621. The spacer 634 has a thickness that is less than a height or depth of the slot 633. Thus, as illustrated in FIG. 6*b*, when the screws 636 are tightened, the thrust washer 635 comes to bear against the rim 632 of the oblong through-opening 621, a head of the screw 636 being "recessed" in the counterbore 631. As a result, when the first base 62 is mounted on the first platform-edge plate 61, the first base 62 is mounted fixedly on this first platform-edge plate 61. Furthermore, the first base 62 comprises a centering stud 624 which projects from an upper face of the first base. This centering stud 624 is either formed as one with the first base 62, or attached to the first base 62 and fixed thereto using a screw 6241 for example. This centering stud 624 allows a first positioning of the end upright 22 of the screen door module 2 as it is being installed. Finally, conical washers 622 are positioned around the through-orifices 623. These conical washers 622 will act as seats for the fixing and adjusting means used to fix and adjust the end upright 22 on the first base 62.

The second base 63 is similar to the first base 62 just described, except that the second base 63 is the mirror image of the first base 62. The second base 63 is mounted on the second platform-edge plate 61' in a similar way. However, the mounting system 625, 635, 636 for mounting the second base 63 on the second platform-edge plate 61' comprises a spacer 625 which has a greater thickness than the spacer 634 already described. It is illustrated in FIG. 6*a*. In fact, the thickness of the spacer 625 is greater than the height or depth of the slot 633 which accepts it with sliding. When the screw 636 is tightened, the thrust washer 635 now comes to press against the spacer 625 rather than against the rim 632 of the counterbore 631. Thus, there is a functional clearance J between the thrust washer 635 and the rim 632 which allows the second spacer 63 to move freely along the slot 633 with respect to the second platform-edge plate 61'. As a result, the second base 63 is mounted with the ability to move in a translational movement in a direction parallel to the axis V of the track, and in a direction of moving towards, or moving away from, the first base 61.

The fixing system 6 according to the invention further comprises fixing and adjusting means 64,65,642, for fixing and adjusting the end uprights 21, 22 on the first 62 and second 63 bases which have just been described. The fixing and adjusting means comprise at least one adjusting and clamping unit comprising a clamping tie rod 642 and a jack screw 65. In this instance, illustrated in the figures, the fixing and adjusting means comprise three adjusting and clamping units positioned in a triangle to face the series of through-orifices 611 in the base 62 or 63 used.

According to one embodiment, the clamping tie rod 642 passes through the base 62 or 63 via the through-orifice 623, the platform-edge plate 61 or 61' via the through-orifice 611, a thickness of the edge 11 of the platform 1 via an open-ended hole 111 made in line with the through-orifice 623. In this embodiment, the fixing and adjusting means comprise an under-platform fixing plate 64 comprising means 641 of screwing a threaded end of the clamping tie rod 642. For example, these means of screwing are nuts 641 welded to the under-platform fixing plate 64.

According to another embodiment not illustrated in the figures, the clamping tie rod 642 is anchored in the thickness of the edge 11 of the platform 1, under the platform-edge plate 61 or 61', using anchoring methods known per se. For example, the clamping tie rod 642 is screwed into an anchor positioned in line with the orifice 611 in the edge 11 of the platform 1, or alternatively positioned in the orifice 111 of the platform edge 11.

The jack screw 65 comprises a body that is a hollow cylinder of revolution 652 comprising on a lateral external surface a screw thread intended to collaborate in screwing with an open-ended tapped hole 72 made in a thickness of the sill 7 of the screen door module 2,3. At a top of the body 652, the jack screw 65 comprises jack-screw operating means in the form of a socket 653. The socket 653 in this instance takes the form of a series of notches uniformly distributed over a periphery of the top of the body 652. The number of notches is comprised between 2 and 4 for example. A bottom end of the body 652 of the jack screw 65 comprises a spherical base 651 intended, during mounting, to collaborate with the conical washer 622 in order to tolerate any axial misalignment between a longitudinal axis of the jack screw and an axis of the conical washer 622. The spherical base 651 is pierced with an orifice coaxial with the body 652 and comprises an upper internal rim against which a head 643 of the clamping tie rod 642 is able to come to bear, which head is then fully accommodated within the body 652 of the jack screw 65. A set 644 of washers with spherical bearing surface that complement one another, and positioned between the internal upper rim of the jack screw 65 and the head 943 of the clamping tie rod 642, makes it possible to compensate for any axial misalignment between the jack screw 65 and the clamping tie rod 642. Furthermore, an O-ring seal 645 is provided to complete the device. It should be noted that, during mounting, the jack screw 65 is housed in the thickness of the sill 7. A cover 71 is then provided to protect the jack screw 65 and the head 643 of the clamping tie rod 642 against external attack.

It should be noted that the first 62 and second 63 bases described hereinabove are preferably made from a material that is electrically insulating so as to allow the screen door module 2, 3 installed using the fixing system 6 according to the invention to be electrically insulated from the platform 1. What is more, one of the washers of the set 644 is also made from a material that is electrically insulating.

A method according to the invention for mounting a screen door module 2, 3 on a platform 1 will now be described. The mounting method according to the invention uses the fixing system 6 according to the invention which has just been described.

Figure 3:
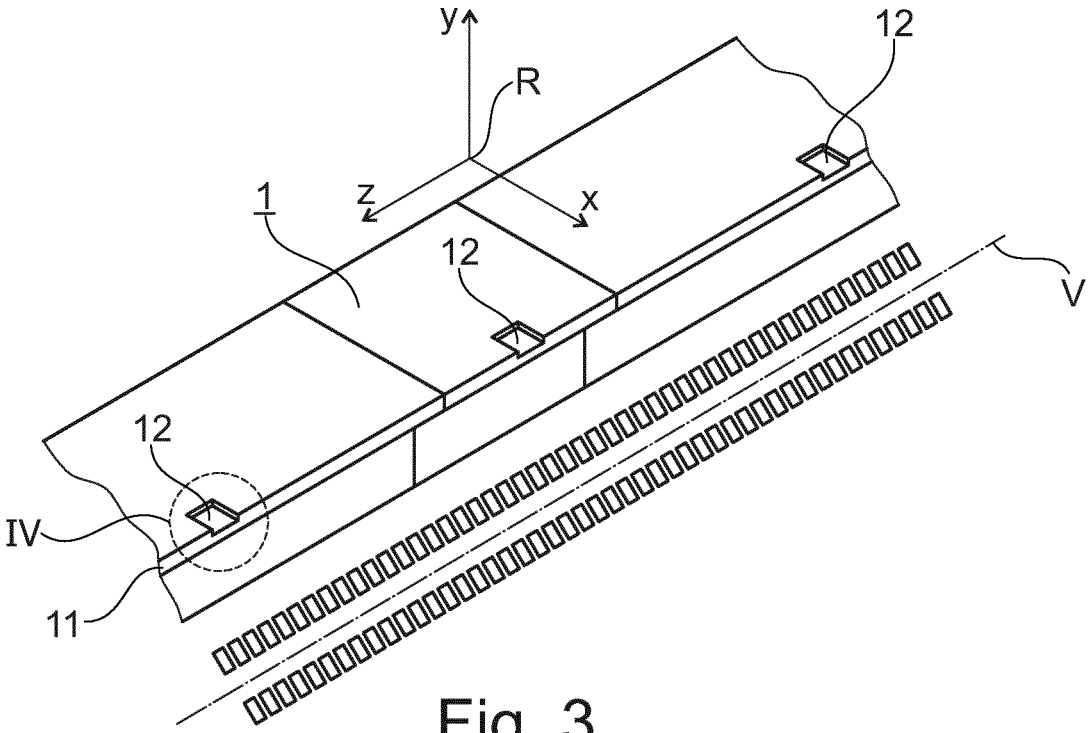
FIG. 3 is a three-dimensional view illustrating the preparation of a platform edge with platform-edge plates of the fixing system according to the invention.
Figure 4:
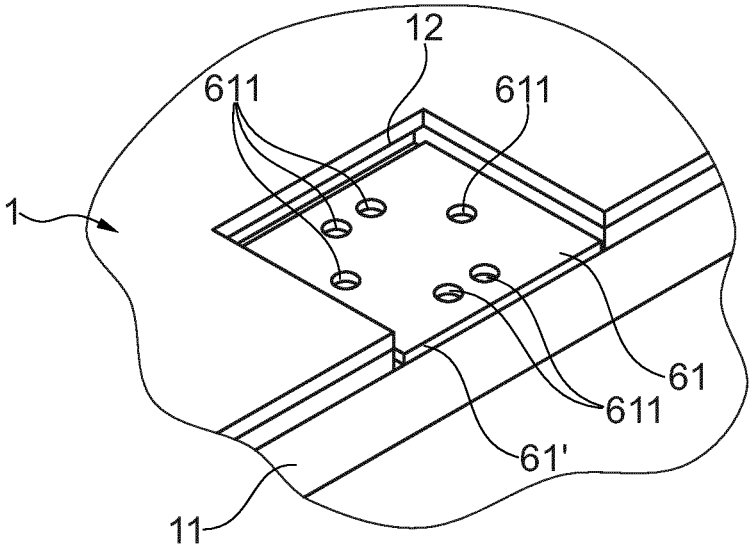
FIG. 4 is a view of detail IV of FIG. 3.

In a first step, illustrated in FIGS. 3 and 4, of the mounting method according to the invention, the first 61 and second 61' platform-edge plates are installed at the level of an upper surface of the platform edge that forms the edge 11 of the platform 1. The platform-edge plates 61,61' are positioned in excavations 12 produced for that purpose. In addition they are positioned at a distance apart that corresponds to a nominal distance between the end uprights 21 and 22 of the screen door module 2,3 that is to be installed on the platform 1. They are also positioned at a predetermined distance from the axis V of the track along which the platform 1 is formed. This step is performed by the civil engineers ahead of the installation of a screen door module 2,3. Once the platform-edge plates 61,61' are in place, a drilling III into the thickness of the platform edge is performed in line with the through-orifices 611 of the platform-edge plates 61,61'. The drillings 111 are either through-holes or blind holes depending on the type of clamping tie rod 642 used subsequently.

Figure 5:
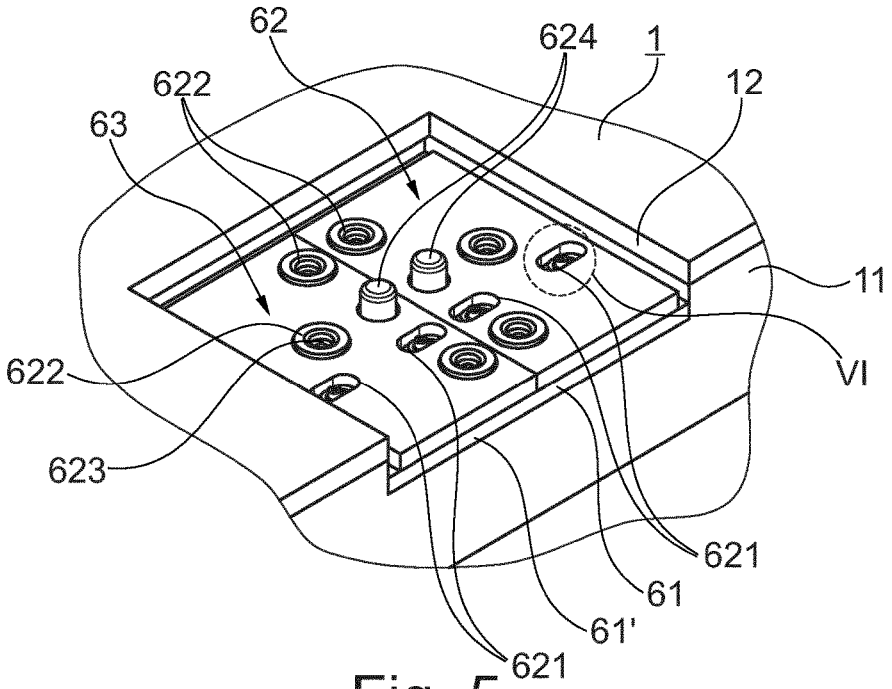
FIG. 5 is the view of FIG. 4, the bases of the fixing system according to the invention fitted to the platform-edge plates.

In a second step, illustrated in FIG. 5 for example, the first 62 and second 63 bases are fitted on the first 61 and second 61' platform-edge plates installed previously. This fitting is performed ahead of the installing of the screen door module 2, 3. In a first phase, the tappings 612 are made in the thickness of the platform-edge plates 61, 61'. These tappings 612 are preferably blind tappings and are positioned with respect to the axis V of the track and according to a theoretical dimension for the distance between centers of the end uprights 21,22 of the screen door module 2, 3 that is to be installed. In a second stage, the bases 62,63 are mounted on their respective platform-edge plates 61, 61', one of them, 62, being mounted fixed and the other, 63, mounted with the ability to slide as described hereinabove. In the event that there is a difference in level between an upper surface of the base 62,63 and the upper surface of the platform 1, protective means forming blocks are installed on the base 62,63 to make up the difference in level to the upper surface of the platform 1, if the upper surface of the base 62,63 is below the level of the upper surface of the platform 1.

In a third step, the preassembled screen door module 2,3 is brought in then laid on the first 62 and second 63 bases. The base mounted with the ability to slide is moved if necessary to take account of the buildup of assembly clearances of the screen door module 2,3 in the process of being installed. The centering studs 624 make the laying of the screen door module 2,3 easier. The centering studs 124 collaborate with an orifice 23 provided for this purpose in the foot of the end uprights 21,22 of the screen door module 2,3.

Figure 7:
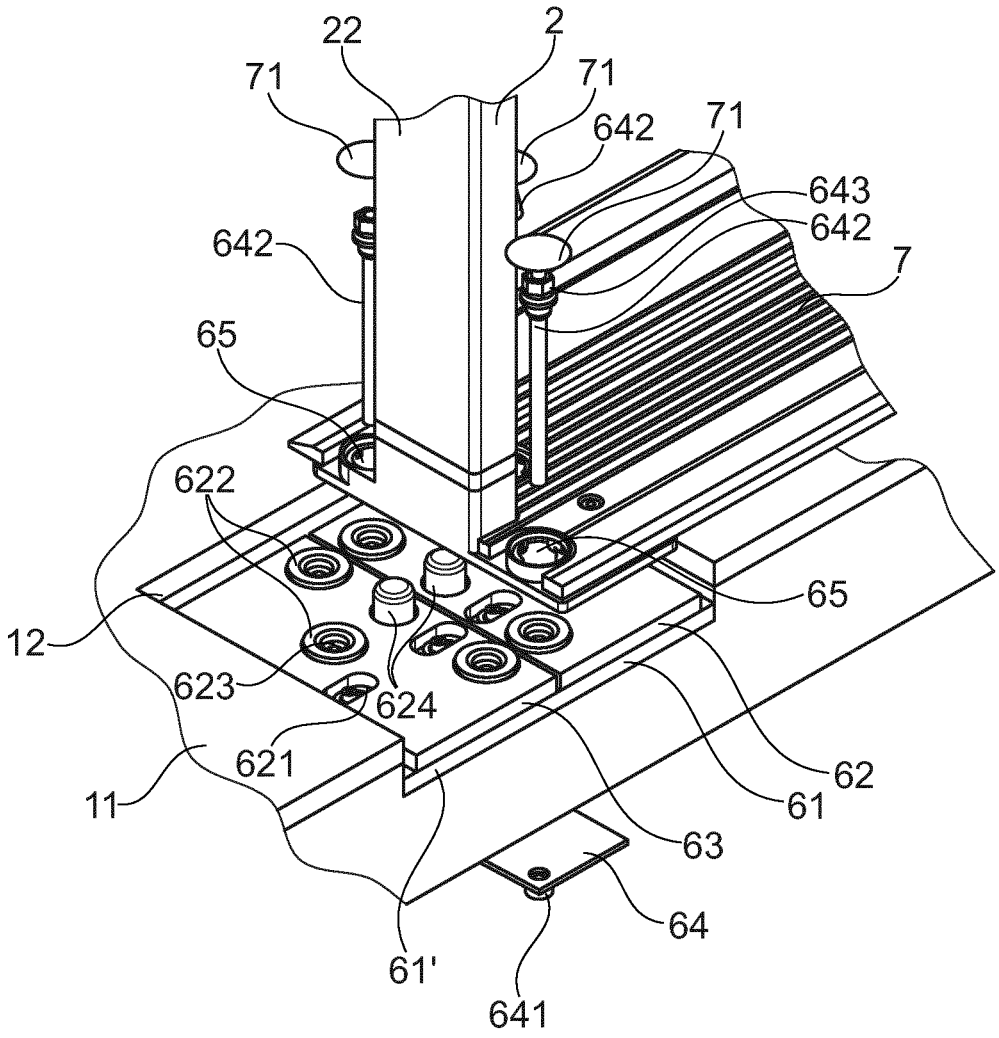
FIG. 7 is a partial three-dimensional exploded view of the assembly of an upright of the screen door module on the platform edge with the fixing system according to the invention.
Figure 8:
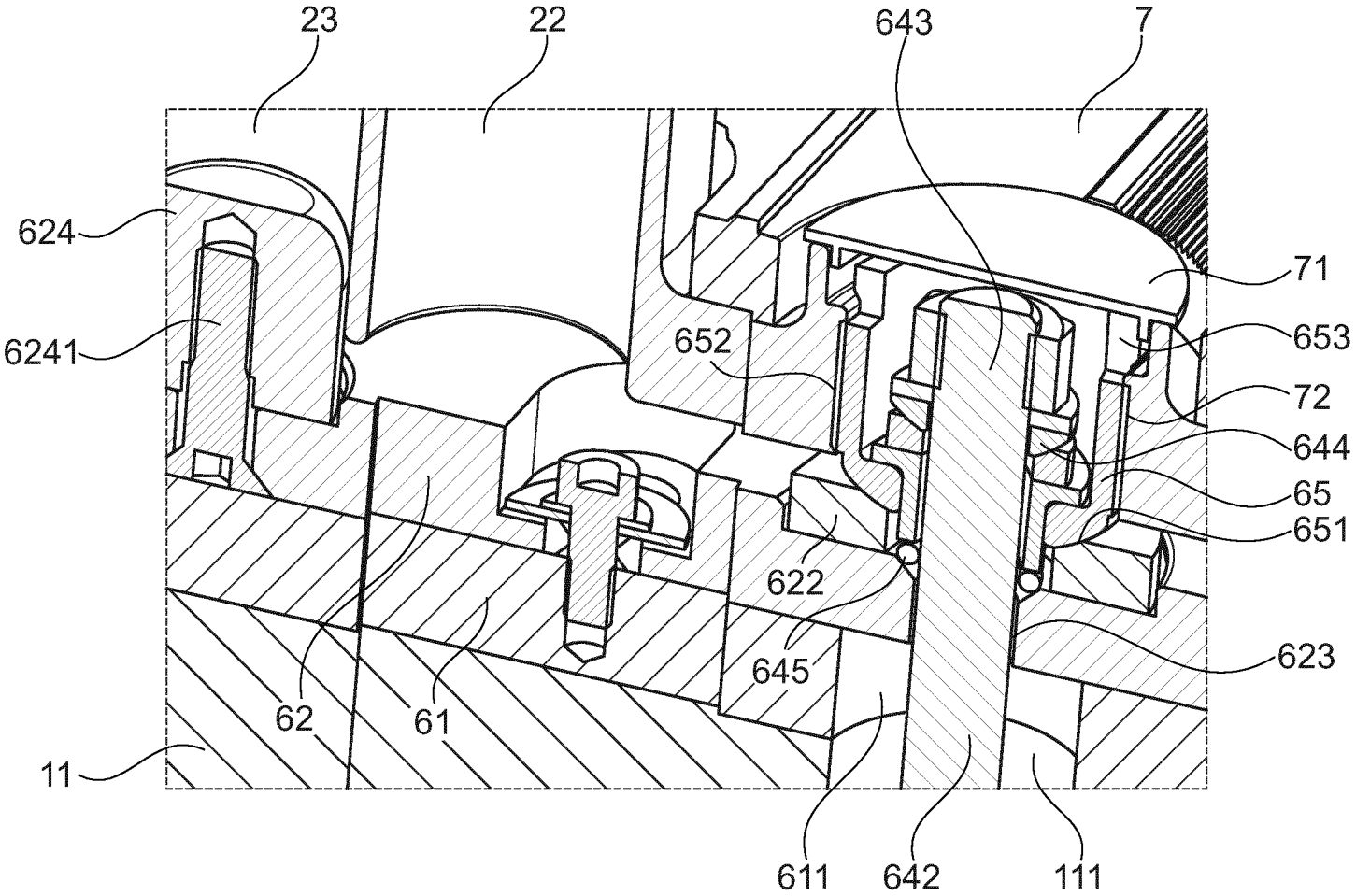
FIG. 8 is a three-dimensional view in cross section of the assembly of FIG. 7.

In a fourth step illustrated in FIGS. 7 and 8, the fixing and clamping means of the fixing system 6 according to the invention are used to ensure the verticality and the fixing of the end uprights 21,22 of the screen door module 2,3 in the process of being installed. To do that, the jack screws 65 are placed in the tapped holes 72 of the sill 7 of the screen door module 2,3.

As an alternative, the fitting of the jack screws 65 may be performed on the site at which the screen door module 2,3 is assembled before it is transported. In that case, holding means are provided in order to prevent the jack screw 65 fitted from rising up in the tapped holes 72 and accidentally escaping during handling and adjustment of the screen door module 2,3.

Next, the clamping tie rods 642 are fitted through the foot of the end uprights 21,22, and through the jack screws 65, then the associated bases 62,63 and the associated platform-edge plates 61,61'. In the case of clamping tie rods that pass through the platform edge 11, the ties are then screwed into the associated under-platform fixing plate 64. In the case of clamping tie rods that are anchored into the thickness of the platform edge, the clamping tie rods 642 are screwed into anchors embedded directly in the thickness of the platform edge in the drillings III, which can then be blind drillings. Whatever the case may be, the clamping tie rods 642 are not tightened at this stage in the mounting method according to the invention.

Next, the verticality of the end uprights 21,22 is adjusted by using the jack screws 65 now pressing via their base 651 on their respective conical washer 622.

Once this verticality adjustment has been made, the clamping tie rods 652 are definitively tightened. Special-purpose tooling allows the jack screw 65 to be held in position during the tightening of the associated clamping tie rod 652 so that the verticality of the end uprights 21,22 is not disturbed during definitive tightening.

Of course, it is possible to make numerous modifications to the invention without thereby departing from the scope thereof.

The invention claimed is:

1. A system for fixing a screen door module to a platform extending along a route and comprising at least one upright at each end and a sill between the at least one upright, the system comprising:

a first platform-edge plate;

a second platform-edge plate;

a first base mounted fixedly on one of the first and second platform-edge plates;

a second base mounted movably on another of the first and second platform-edge plates with a translational movement in a direction parallel or tangential to the route, and in a direction of moving towards, or moving away from, the first base; and an adjustable fastener to fix and adjust a respective upright on each of the first and second bases, wherein at least one of the first and second platform-edge plates forms the other of the first and second platform-edge plates of a system for fixing an adjacent screen door module.

2. The fixing system according to claim 1, further comprising a fastener to secure the first and second base on a respective platform-edge plate, the fastener comprising a clamping screw and a spacer received in an oblong opening passing through a thickness of the base.

3. The fixing system according to claim 2, wherein the spacer for mounting the second base has a thickness greater than a depth of the oblong opening.

4. The fixing system according to claim 2, wherein the spacer for mounting the first base has a thickness less than a depth of the oblong opening.

5. The fixing system according to claim 2, wherein the oblong opening has a counter bore for receiving a head of the clamping screw.

6. The fixing system according to claim 1, wherein adjustable fastener comprises at least one jack screw bearing against the base and configured to be screwed near a foot of the end upright, and a clamping tie rod passing through the jack screw and the base.

7. The fixing system according to claim 6, wherein the clamping tie rod traverses the respective platform-edge plate, with the respective platform-edge plate having a through-orifice to receive the clamping tie rod and having a diameter greater than a diameter of the clamping tie rod.

8. The fixing system according to claim 6, wherein the clamping tie rod is anchored in an edge of the platform.

9. The fixing system according to claim 6, further comprising an under-platform fixing plate cooperating with the clamping tie rod, wherein the clamping tie rod passes through a thickness of a platform edge.

10. The fixing system according to claim 6, wherein the jack screw comprises a spherical end-piece and the base comprises a conical washer arranged to receive in abutment the spherical end-piece of the jack screw.

11. The fixing system according to claim 6, comprising three jack screws positioned to define a triangle shape.

12. The fixing system according to claim 1, wherein the first base and the second base each comprise a stud for centering the respective end upright fixed to the base.

13. The fixing system according to claim 1, wherein at least one of the first base and the second base is made of an electrically insulating material.

14. The fixing system according to claim 1, wherein the first base and the second base have a functional clearance therebetween that is arranged to provide a relative inclination between the first base and the second base in a plane of the platform.

15. A system for fixing a screen door module to a platform extending along a route and comprising at least one upright at each end and a sill between the at least one upright, the system comprising:

a first platform-edge plate;

a second platform-edge plate;

a first base mounted fixedly on one of the first and second platform-edge plates;

a second base mounted movably on another of the first and second platform-edge plates with a translational movement in a direction parallel or tangential to the route, and in a direction of moving towards, or moving away from, the first base;

an adjustable fastener to fix and adjust a respective upright on each of the first and second bases; and a fastener to secure the first and second base on a respective platform-edge plate, the fastener comprising a clamping screw and a spacer received in an oblong opening passing through a thickness of the base.

16. A method for mounting, with the aid of a fixing system, a screen door module on a platform extending along a route and comprising at least one upright at each end, wherein the fixing system comprises:

a first platform-edge plate;

a second platform-edge plate;

a first base mounted fixedly on one of the first and second platform-edge plates;

a second base mounted movably on another of the first and second platform-edge plates with a translational movement in a direction parallel or tangential to the route, and in a direction of moving towards, or moving away from, the first base; and an adjustable fastener to fix and adjust a respective upright on each of the first and second bases, wherein at least one of the first and second platform-edge plates forms the other of the first and second platform-edge plates of a system for fixing an adjacent screen door module, the method comprising:

(a) placing the first and second platform-edge plates at a platform edge at a distance from one another corresponding to a distance between the end uprights of the screen door module; then, (b) placing and fixing the first and second bases respectively on the first and second platform-edge plates; then, (c) laying the screen door module on the first and second bases, by sliding the second base with respect to the first base; then, (d) working the adjustable fastener associated with the first and second bases to fix the end uprights in a vertical position relative to the platform.

17. The mounting method according to claim 16, wherein process (a) comprises drilling through-orifices in a thickness of the platform edge opposite tie-receiving through-orifices of the platform-edge plates.

18. The mounting method according to claim 16, wherein process (b) comprises producing tappings in the platform-edge plates, the tappings being configured to receive clamping screws to mount the first base and the second base on respective platform-edge plates.

19. The mounting method according to claim 16, wherein process (d), for each end upright of the screen door, further comprises:

i. placing clamping tie rods through a foot of the end upright, through an associated base, through an associated platform-edge plate and through the platform edge by screwing the ties to an associated under-platform fixing plate or into anchorings; then, ii. adjusting the verticality of the end upright by working the jack screws; then, iii. clamping the clamping tie rods.

* * * * *